US011769475B1

(12) United States Patent
Tedesco

(10) Patent No.: US 11,769,475 B1
(45) Date of Patent: Sep. 26, 2023

(54) BELL MUSIC INSTRUMENT FOR WHIRL SOUND EFFECT

(71) Applicant: Charles Tedesco, Patchogue, NY (US)

(72) Inventor: Charles Tedesco, Patchogue, NY (US)

( * ) Notice: Subject to any disclaimer, the term of this patent is extended or adjusted under 35 U.S.C. 154(b) by 0 days.

(21) Appl. No.: 17/837,952

(22) Filed: Jun. 10, 2022

(51) Int. Cl.
*G10D 13/08* (2020.01)
*G10D 13/10* (2020.01)
*G10D 13/24* (2020.01)

(52) U.S. Cl.
CPC ..... *G10D 13/08* (2013.01); *G10D 13/24* (2020.02); *G10D 13/28* (2020.02)

(58) Field of Classification Search
CPC ..... G10D 13/08
See application file for complete search history.

(56) References Cited

U.S. PATENT DOCUMENTS 4,949,385 A * 8/1990 Murphy ..... G10K 1/10 446/166
11,200,873 B2 * 12/2021 Cooke ..... G10D 13/08
2008/0078278 A1 * 4/2008 Malta ..... G10D 13/08 116/169
2019/0189095 A1 * 6/2019 Cooke ..... G10D 13/08

* cited by examiner

*Primary Examiner* — Robert W Horn
(74) *Attorney, Agent, or Firm* — Harold G. Furlow Attorney At Law

(57) ABSTRACT

A handheld bell music instrument for whirl sound effect is described that includes multiple disc shaped bells that connect to and are fixed at a location on the rod. The bells of the bells are rung to produce a pitch and the rod is used to move the bell music instrument for whirl sound effect in space. The movement of the ringing bells produces a whirling sound effect by their movement relative to a static audience.

20 Claims, 9 Drawing Sheets

Z

BELL MUSIC INSTRUMENT FOR WHIRL SOUND EFFECT

BACKGROUND OF THE INVENTION

Field of the Invention

The present disclosure relates to a handheld bell music instrument for creating music and in particular to a handheld bell musical instrument structured for ringing while moving in space to create a whirl sound effect.

Description of the Related Art

Musical instruments are structured to create different sounds through the vibration of strings in the air, a stream of air that vibrates a reed in a horn, or the vibration of materials such as metal in the form of xylophones, drums, bells, cymbals and stretched membranes such as those for tambourines and drums. Less frequently musical instruments are physically moved to make sound such as the jingles of tambourines and handheld bells. Heretofore there has never been an arrangement of one or more disc-shaped bells in a handheld instrument that is specifically structured for hand movement while ringing to create a whirl sound effect.

SUMMARY OF THE INVENTION

The bell music instrument is structured for the moving of a ringing disc shaped bell in an innovative manner to create different whirl sound effects. The bell music instrument includes a rod, a bell, and a pair of stops. The bell music instrument is intended to be a handheld musical instrument that can be easily manipulated with one or two hands.

The rod has a cylindrical shape that includes a first end portion and an opposed second end portion. The first end portion includes a first end and the second end portion includes a second end. The rod has a length that is defined as the length between the first end and the second end. The first end and the second end are also identified herein as the ends of the rod. The cylindrical shape of the rod defines a circumference that extends the length of the rod. The circumference of the rod includes an outer surface of the rod. The circumference of the rod also defines a center of the rod. The centers of the circumferences of the rod define a centerline of the rod. The rod has a midway point that is equidistant from the ends of the rod.

The bell has a disc shape. The bell disc shape is flat, thin, and has a round outer edge. The bell includes a first side and a second side. The first side opposes the second side. The first side and the second side of the bell are parallel. The first side and the second side of the bell are planar. An outer rim connects the first side and the second side of the bell. The outer rim is an outer circumference of the bell. The outer rim defines an outer circular perimeter of the bell. The outer rim has a length. An inner rim connects the first side and second side of the bell. The inner rim defines an inner circumference of the bell. The inner rim defines the inner circular perimeter of the bell. The circumference of the inner rim has a length and a diameter. The inner rim defines an aperture in the bell that is a through hole that extends between the first side and the second side. The aperture is aligned perpendicular to the opposing sides. It is understood that above description is a preferred embodiment of bell music instrument can vary from the above descriptions such as for example, planar and circular, to include for example protuberances, undulations, concave, and/or convex portions depending upon the intended application of the bell music instrument.

The bell and rod are connected. The length of the circumference of the inner rim of the bell is greater than the length of the circumference of the outer surface of the rod. The connection between the bell and rod includes the inner rim of the bell having a close-fitting relationship with the outer surface of the rod. The bell is positionable at locations along the length of the rod. The inner rim of the bell provides for the translational movement of the bell along the length of the outer surface of the rod, or length of the rod, and relative to the rod. The inner rim provides for the rotational movement of the bell about the centerline of the rod and relative to the rod. The bell is positioned at a location on the length of the rod. The term "the bell" or "a bell" as used herein is understood to mean at least one bell.

The pair of stops or the two stops of the bell music instrument are connected to the rod. Each stop of the two stops connects to the rod. Each stop is movable along the length of the rod and relative to the rod. The movement of each stop along the length of the rod includes the translation of each stop on the outer surface of the length of rod. Each stop is rotatable about the centerline of the rod and relative to the rod. Each stop is positionable at any location on the length of the rod. Each stop includes a locking mechanism that fixes the stop at the location on the rod.

Two stops are typically associated with each bell. Each stop of the two stops is located on the rod in proximity to one of the opposing sides of the bell. The two stops retain the bell at the location on the rod between the two stops. Each stop is located in close proximity or proximity to one of the opposing sides of the bell. The two stops accommodate the rotational movement of the bell about the centerline of the rod and relative to the rod. The two stops bracket the location of the bell on the rod. The two stops limit the translational movement of the bell between the location of the two stops on the rod when the bell music instrument is stationary or moving. The stops are in fixed spaced location relative to one another and on the opposing sides of the bell.

The two stops have a close-fitting relationship with the outer surface of the rod. Each stop is located adjacent to either the first side or the second side of the bell. Each stop adjoins either the first side or the second side of the bell. A first stop of the two stops is located on the rod in proximity to the first side of the bell and the second stop of the two stops is located in proximity to the second side of the bell. The two stops retain the bell at a location on the rod between the two stops; the two stops bracket the bell. Each stop has translational movement along the length of the rod and relative to the rod. Each stop has rotational movement of the stop about the centerline of the rod and relative to the rod. Each stop includes a locking mechanism that fixes the stop at a location on the length of the rod. The location of each of the stops of the two stops is on the opposing sides of the bell. The location of the two stops is such that one stop of the two stops is in proximity to the first side of the bell and the other stop of the two stops is in proximity to the second side of the bell. The two stops accommodate the rotational movement of the bell about the centerline of the rod and relative to the rod. The two stops preferably retain the bell at an angle approximately perpendicular to the centerline of the rod. The two stops limit the translational movement of the bell at the location of the bell on the rod between the two stops when the bell music instrument is stationary, stationary, and ringing, and when the bell music instrument is moving and ringing.

The bell music instrument is structured for movement while the bell is ringing. The bell music instrument is structured for the simultaneous ringing and moving in space while each bell is retained at the location on the rod between the location of the two stops connected to the rod. The bell music instrument is structured for the creation of a whirl sound effect.

The material of the bell of the bell music instrument is preferably MIC-6 aluminum. The bell of the bell music instrument as defined herein can also include two or more bells. The two or more bells include a first bell with a first outer rim and a second bell with a second outer rim. The length of the second outer rim is different from the length of the first outer rim; the two or more bells have disc-shapes with different diameters. Each bell of the two or more bells has one stop of the two stops located adjacent to each of the opposing sides of the two or more bells. The two or more bells are located on the outer surface of the rod and the stops locate the bells in fixed space separation from one another.

Each stop of the two stops of the bell music instrument includes a collar. The collar has an annular or disc shape. The collar has an inner rim, a first side, a second side and an outer edge. The inner rim of each collar defines an aperture. The collars are connected to the rod. The rim of the collar and the rod connect such that the collar is positionable at any locations on the length of the rod. A first collar of the first stop of the two stops is located in proximity to the first side of the bell and a second collar of the second stop of the two stops is located in proximity to the second side of the bell. Each collar includes a locking mechanism that fixes the collar at a location on the rod. The first collar and second collar of the two stops retain the bell at an angle approximately perpendicular to the centerline of the rod.

Each stop of the two stops for each bell can further include two cymbal felts. Each collar and each cymbal felt of the two stops has an inner rim, a first side, a second side that opposes the first side, and an outer edge. The inner rim of each collar and each cymbal felt of the two stops defines an aperture.

The collars and cymbal felts of the two stops are connected to the rod. The apertures of the collars and cymbal felts and the outer surface of the rod are connected. The apertures of the collars and cymbal felts and the rod connect to position the collars and cymbal felts of each of the stops at locations on the rod. A first cymbal felt of the first stop of the two stops is located on the rod in close proximity to the first side of the bell and a second cymbal felt of the second stop of the two stops is located in close proximity to the second side of the bell. A first collar of the first stop of the two stops is located on the rod in close proximity to the first cymbal felt and a second collar of the second stop of the two stops is located in close proximity to the second cymbal felt. The first cymbal felt is located between the first side of the bell and the first collar and the second cymbal felt is located between the second side of the bell and the second collar.

The bell music instrument includes three or more bells. Each bell of the three or more bells preferably has a different diameter. Each bell of the three or more bells preferably has a different pitch. Each bell of the three or more bells preferably has a different diameter. A first bell has a diameter of ten (10) inches, a second bell has a diameter of eight (8) inches, and a third bell has a diameter of eleven (11) inches. The bell music instrument can further include a mallet. The mallet has a first end portion that is a handle and an opposed second end portion that includes a head.

The rod of the bell music instrument can include one or more handles. The first end portion of the rod connects to a handle and the second end portion of the rod can be connected to another handle. The handle can also be a stop. The bell music instrument can include a line. The line is connected to the rod. The line can aid the innovative movement of the bell music instrument to create the whirl sound effect. Line can also include a handle. The whirl sound effect is also known as a doppler sound effect.

DETAILED DESCRIPTION OF THE INVENTION

Figure 1:
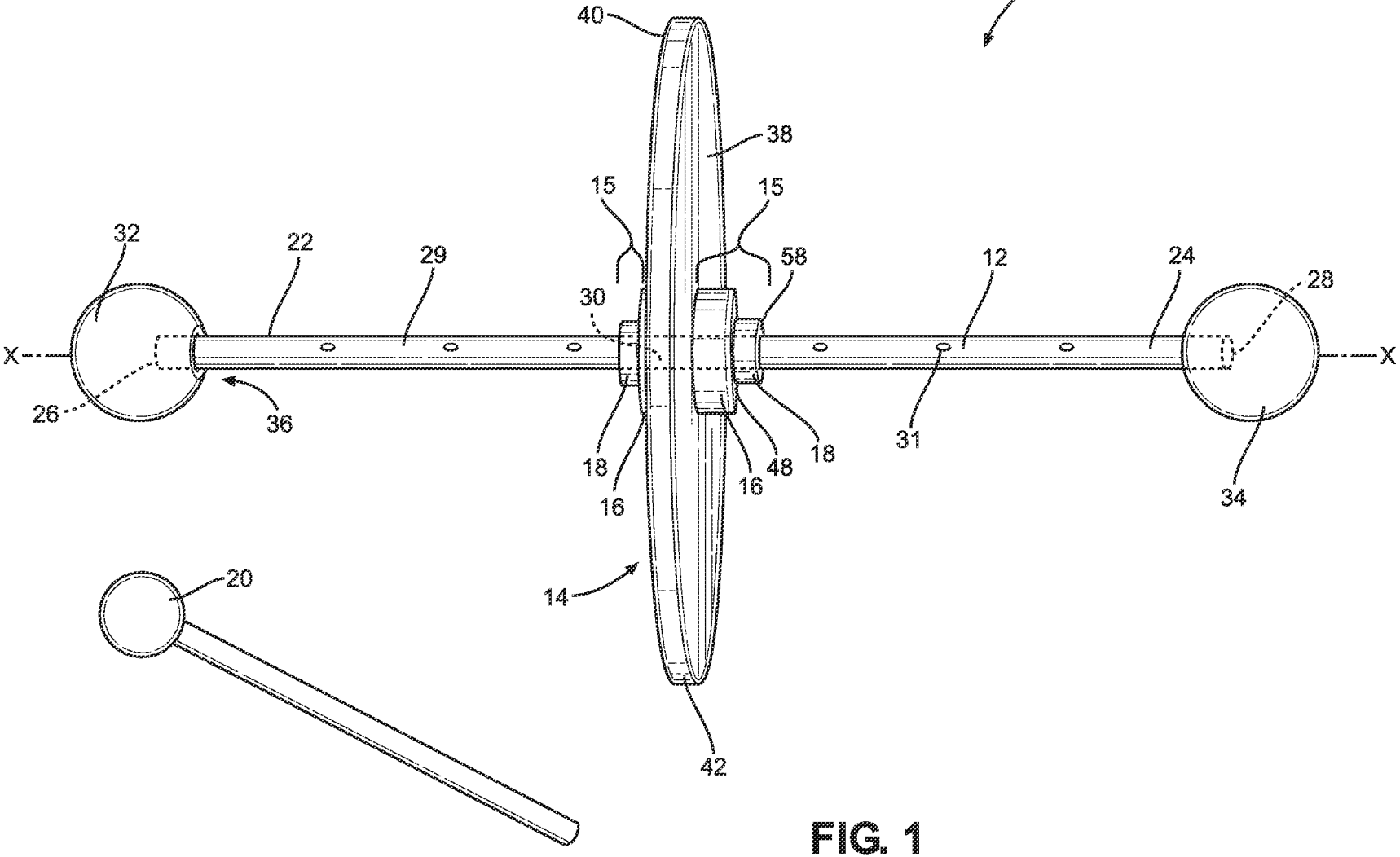
FIG. 1 is a frontal and a second side perspective view of a Bell Music Instrument for Whirl Sound Effect with a bell in accordance with the present disclosure.

Referring initially to FIG. 1, a bell music instrument for a whirl sound effect 10 includes a rod 12, a bell 14, and a pair of stops 15. In one preferred embodiment, each stop 15 of the bell music instrument for sound effect 10 or bell music instrument 10, includes a cymbal felt 16 and a collar 18. Bell music instrument 10 can further include a mallet 20. The bell music instrument 10 is structured to create a whirl sound effect by the relative motion between the ringing bell 14 of bell music instrument 10 and an audience.

Rod 12 has a cylindrical shape. Rod 12 includes a first end portion 22 and an opposed second end portion 24. The first end portion 22 includes a first terminal end 26 and the second end portion 24 includes a second terminal end 28. Rod 12 preferably has a straight alignment with an outer surface 29 that includes first terminal end 26, second terminal end 28, the cylindrical shaped outer surface 29 of rod 12. A longitudinal midway point 30 of rod 12 is equidistant from first terminal end 26, or first end 26, and second terminal end 28, or second end 28. In this one preferred embodiment, cylindrically shaped rod 12 has a diameter of approximately 0.39 inch and a length of approximately thirteen (13) inches. The circumference of rod 12 between first end 26 and second end 28 defines an outer surface 29 of rod 12 and a centerline of rod 12. The centerline of rod 12 is aligned with a longitudinal axis-X. The outer surface 29 can also include surface features 31 such as, for example, undulations, knurling, and/or protuberances. Rod 12 can be made of a wide variety of materials including, but not limited to metals, ceramics, composite materials, glass, polymers, and cellulose. In the preferred embodiment, rod 12 is made of aluminum and weighs approximately eight tenths (0.8) of a pound. It is understood that the shape, structure, weight, and materials of rod 12 can vary depending upon a desired application of bell music instrument 10. For example, it is understood that rod 12 could also have a tubular structure as defined herein.

Rod 12 can include one or more structures to facilitate the movement of bell music instrument 10. The exemplary outer surface features 31 on rod 12 described above, for example, can be structured to facilitate the holding and manipulating of rod 12 by a human hand in two-dimensional and three-dimensional space. Structures to facilitate the movement of bell music instrument 10 can further include a handle 32. In one preferred embodiment, the first end portion 22 of rod 12 connects to handle 32. Rod 12 can also have a structure that includes handle 32 as a first handle 32 in combination with a second handle 34. In this one preferred embodiment, second handle 34 connects to the second end portion 24 of rod 12. First handle 32 and second handle 34 preferably have a spherical shape with a one and one-half (1.5)inch diameter, but it is understood that handles 32 and 34 can vary in shape to include tubular or rectangular, for example, and tailored in size, shape, and materials for a particular application of handles 32 and 34 with bell music instrument 10.

First handle 32 and second handle 34, or handles 32 and 34, are preferably constructed of a material such as a resilient rubber or polymer. The term "handles" are referred to herein can include or more handles 32 and a reference to handle 32 is applicable to all the handles 32 and 34 unless noted otherwise. The surface of handles 32 and 34 can further include, for example, undulations, chemical treatments, knurling and/or protuberances to facilitate the holding and manipulating of rod 12 of bell music instrument 10. Handles 32 and 34 can be positioned at any location along the length of rod 12. Equivalent structures for handle 32 and/or handles 32 and 34 can include for example apertures, knurling, or channels in rod 12 and straps, loops or webbing connected to rod 12 that facilitate the grasping and controlled movement of rod 12. Handles 32 and 34 are optional structures associated with rod 12 of bell music instrument 10. It is understood that the term the length of rod 12 can include the length of rod 12 between first handle 32 and second handle 34 as well as between first end 26 and second end 28 of rod 12.

Figure 2A:
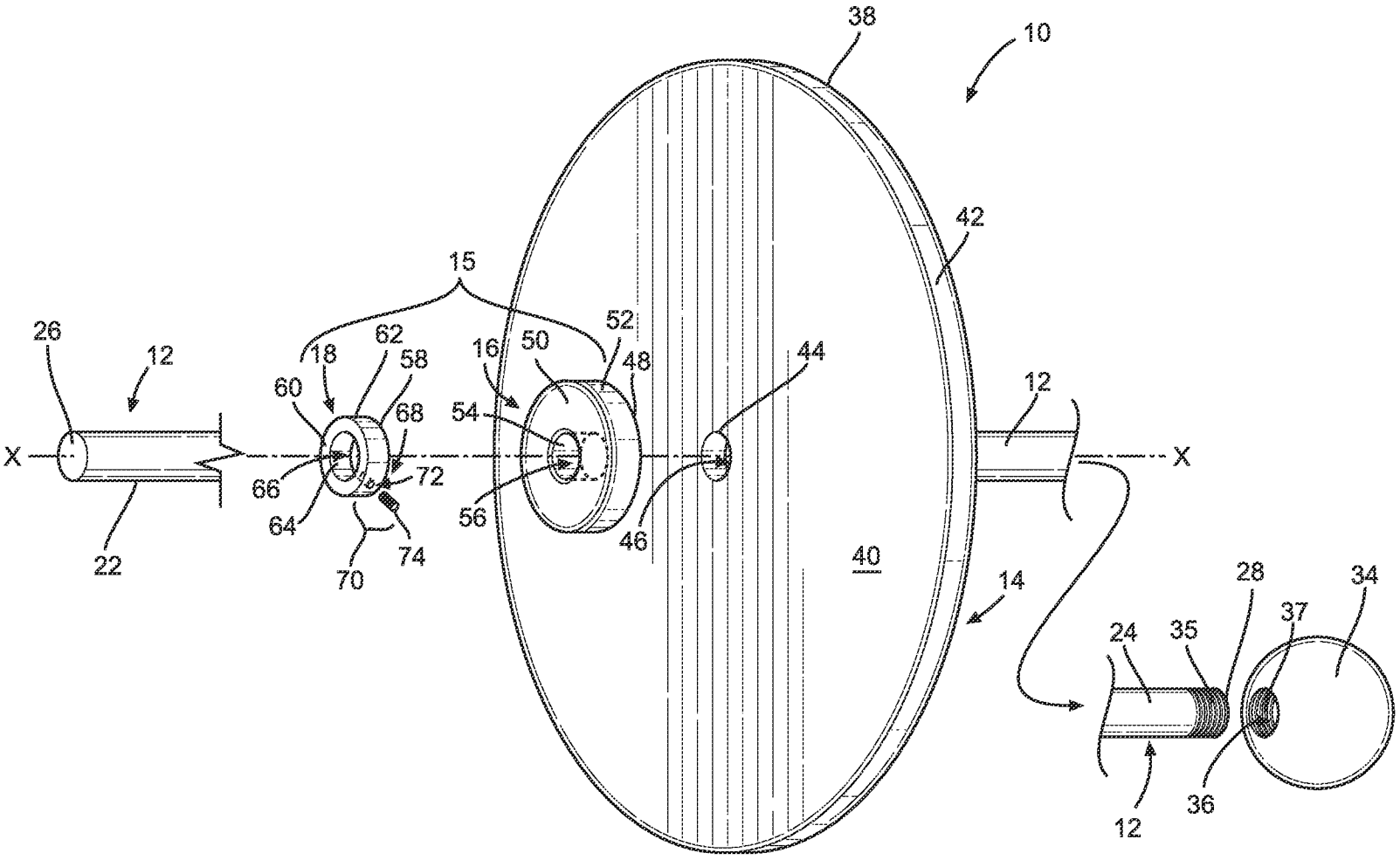
FIG. 2A is an exploded close-up frontal and a first side perspective view of the Bell Music Instrument for Whirl Sound Effect of FIG. 1 in accordance with the present disclosure.

As shown in FIGS. 1 and 2A, the connection between rod 12 and first handle 32 and second handle 34 can include any type of connective mechanism such as, for example, the use adhesives, heat bonding, mechanical devices, and/or friction that suitably secure the connection of handles 32 and 34 to rod 12 for the operational use of bell music instrument 10. For example, the interface between first handle 32 and second handle 34 and rod 12 can include handle 32 and/or handle 34 being fixed in a position at a location on rod 12, fixed at a location and rotatable about the centerline of rod 12 and relative to rod 12, and/or translatable on and/or rotatable about the centerline or longitudinal axis of rod 12 and relative to rod 12 between defined limits. In one preferred embodiment, first handle 32 and second handle 34 each define an aperture 36. The aperture 36 can be a through hole in handles 32 and 34 or have a defined depth within each of handles 32 and 34. As shown, handles 32 and 34 are spherical in shape with aperture 36 having a diametrical alignment, but it is understood that handles 32 and 34 can have alternative shapes such as cylindrical and/or tubular, for example.

In one preferred embodiment, rod 12 first end portion 22 and/or second end portion 24 include threads 35 that mate with first handle 32 and/or second handle 34. Aperture 36 of first handle 32 and second handle 34 each define threads 37 on at least a portion of the interior walls of their respective apertures 36 that mate with threads 35 on the second end portion 24 and/or first end portion 22 of rod 12. The threads 35 rod 12 and threads 37 of handles 32 and 34 can fix handles 32 and 34 in a position on rod 12. The threads 35 of rod 12 and threads 37 of handles 32 and 34 can also be structured to accommodate the selective disengagement of first handle 32 and/or second handle 34 from threads 35 while retaining the connection of handle 32 and/or handle 34 to a location on rod 12 so as to allow the free rotation and/or translation of handle 32 and handle 34 relative to rod 12 as described above.

Bell 14 has a disc-shaped structure. Bell 14 preferably has a flat shape. Bell 14 includes a first side 38 and a second side 40. The first side 38 and second side 40 are opposed sides of the disc-shaped structure of bell 14. In one preferred embodiment the first side 38 and second side 40 are structurally symmetrical with planar shaped parallel outer surfaces. First side 38 and second side 40 extend between an outer rim 42 and an inner rim 44 of bell 14. Outer rim 42 has a circular shape that connects to the first side 38 and second side 40. Outer rim 42 defines a circular shape that is an outer circumference of the disc-shaped structure of bell 14. Outer rim 42 defines a diameter of bell 14.

Inner rim 44 has a circular shape and defines an inner circumference of disc shaped bell 14. Inner rim 44 is preferably concentric with outer rim 42. Inner rim 44 is opposed to outer rim 42 and connects to first side 38 and second side 40. The circumference of inner rim 44 has a length. Inner rim 42 has a diameter. Outer rim 42 and inner rim 44 are preferably aligned perpendicular to first side 38 and second side 40. It is understood that the shape of the surface of outer rim 42 and inner rim 44, first side 38, and second side 40 can vary depending upon the application of bell 14 such as, but not limited to straight, undulated, concave, perforated, convex, and/or angled.

Inner rim 44 defines an aperture 46. Aperture 46 is a through hole in bell 14 that extends between first side 38 and the second side 40. Aperture 46 is preferably located at the center of the disc-shaped bell 14 and aligned perpendicular to the disc shaped bell 14. Aperture 46 is preferably perpendicular to the planar first 38 and second side 40 of bell 14. The length of the circumference of inner rim 44 is larger than the length of the circumference of outer surface 29 of rod 12. Inner rim 44 preferably has a close-fitting relationship with the outer surface 29 of rod 12. Inner rim 44 provides for the free movement of bell 14 along the length of the outer surface 29 of rod 12. Inner rim 44 provides for the free rotation of bell 14 relative to the outer surface 29 of rod 12 and about the centerline of rod 12.

Bell 14 is a metal disc. In the preferred embodiment, bell 14 is a MIC 6 solid aluminum cast plate having a thickness between first side 38 and second side 40 of approximately one-quarter (¼) inch, outer rim 42 defines a diameter of approximately two hundred and fifty-four (254) millimeters or approximately (10) inches, and inner rim 44 has a diameter that is greater than and has a close-fitting relationship with the ten (10) millimeter diameter of rod 12.

Applicant conducted an extensive trial and error testing of the sound producing qualities of varied materials for bell 14. The tested materials included disks of solid brass, AR 400 steel, copper, stainless steel 304 and a variety of different grades of aluminum. The testing also included assessing the change to the pitch producing quality of the bell 14 by varying the dimensions of the test material such as the thickness and the shape of the bells 14. As a result of that testing, MIC-6 cast aluminum plate having a one-quarter (¼) inch thickness had the most favorable test results of sound quality and consistency. The manufacturing tolerance of first side 38 and second side 40 of bell 14 is −0.005 to +0.005 inch and a flatness tolerance of 0.015. The result of these standards is a favorable and consistent sound characteristics of aluminum disc-shaped bells 14 relative to the sound creating characteristics of other metals and the other tested materials. The secondary benefit is the light weight of aluminum facilitates the ease of hand manipulation of the at least one bell 14 on rod 12. It is understood that the terms at least one or one or more and their respective numerical variations are equivalents. The different pitches of bell 14 are created by changing the dimensions of bell 14 such as, for example, varying the thickness between sides 38 and 40, length of the circumference or outer rim 42 of bell 14, and/or the length or circumference of inner rim 44 of bell 14.

The disc shape of bell 14 was selected because of the consistency of the pitch produced by the MIC 6 aluminum and circular shape of outer rim 42. Bell 14 is typically rung by striking outer rim 42. By striking outer rim 42, bell 14 advantageously produces a consistent pitch independent of where bell 14 is struck along outer rim 42. Other bells with external shapes such as rectangular, square, or oval will produce a variation in pitch depending on where the bell is struck relative to the non-uniform outer rim, corner, or thickness.

Each stop 15 of bell music instrument 10 preferably includes a cymbal felt 16 and a collar 18. In select configurations of stop 15 it is understood that cymbal felt 16 can be an optional component. Stop 15 can take many different structural shapes and have different components depending upon the intended uses of bell music instrument 10. Stop 15 is structured to minimize any damping of the pitch of bell 14.

Cymbal felt 16 has a disc-shaped structure and is preferably a standard commercially available cymbal felt that is structured or has a structure that can be modified to connect to cylindrical-shaped structures such as rod 12. In the preferred embodiment, cymbal felt 16 has a disc-shaped structure that includes a first side 48 and a second side 50. The first side 48 and the second side 50 are preferably opposed, structurally symmetrical, and functionally identical. An outer edge 52 connects to first side 48 and second side 50. Outer edge 52 defines a perimeter and the perimeter has a length. The outer edge 52 typically has a circular shape that defines an outer circumference of cymbal felt 16, but outer edge 52 can have any shape. An inner rim 54 of cymbal felt 16 connects the first side 48 and the second side 50. The inner rim 54 typically has a circular shape that defines an inner circumference of cymbal felt 16. The circumference of inner rim 54 has a length. The outer edge 52 and inner rim 54 are coaxial. Cymbal felts 16 have a thickness between first side 48 and second 50 that can vary depending upon the materials of cymbal felt 16 and the intended application of bell music instrument 10.

The inner rim 54 of cymbal felt 16 defines a circular aperture 56. Aperture 56 is a through hole that extends between the first side 48 and the second side 50. Aperture 56 is aligned perpendicular to the planes defined by the first side 48 and the second side 50 of cymbal felt 16. Circular aperture 56, inner rim 54, and outer edge 52 are coaxial. The thickness of cymbal felt 16 is preferably between three-eighths (⅜) inch and one-half(½) inch.

The length of the circumference of inner rim 54 of cymbal felt 16 is greater than the length of the circumference of outer surface 29 of rod 12. Aperture 56 is defined by inner rim 54 and is structured to receive the first end 26 or the second end 28 of the rod 12. Rod 12 is positioned through aperture 56 such that cymbal felt 16 first side 48 and second side 50 are aligned perpendicular to the centerline of rod 12 and longitudinal axis-X. In the preferred embodiment, the circumference of inner rim 54 has a close-fitting relationship with the circumference of the outer surface 29 of rod 12. Inner rim 54 provides free translational movement of the cymbal felt 16 along the length of the rod 12. Inner rim 54 provides for the rotational movement of cymbal felt 16 relative to rod 12 and about the centerline of rod 12. Cymbal felt 16 inner rim 54 and outer surface 29 of rod 12 are structured to connect through cymbal felt 16 aperture 56.

As noted above, cymbal felt 16 can be one of many commercially available cymbal felt products that have a wide variety of shapes, dimensions, and materials as long as the commercially available cymbal felt product meets the minimal structural parameters defined herein. Cymbal felts 16 can also be custom made for applications with bell music instrument 10. Cymbal felts 16 as described herein can also be fabricated of alternative materials such as, but not limited to cellular foam and/or take the structure of a bias member or spring, for example.

Continuing with FIGS. 1 and 2A, collar 18 has an annular structure and is preferably a standard commercially available collar or clamp that connects to cylindrical shaped structures such as rod 12. Collar 18 includes a first side 58 and a second side 60. The first side 58 and the second side 60 are opposed and typically structurally equivalent and functionally identical. An outer edge 62 connects first side 58 and second side 60. Outer edge 62 can have any shape such as angular or circular, but preferably has a circular shape. Outer edge 62 defines a perimeter of collar 18 and the perimeter has a length. An inner rim 64 connects first side 58 and second side 60. Inner rim 64 defines an aperture 66 that is a through hole in collar 18 that extends between first side 58 and second side 60. Inner rim 64 defines a circular shape, outer circumference, and a center of aperture 66.

In one preferred embodiment of collar 18, first side 58 and second side 60 have approximately planar shapes and aperture 66 is perpendicular to first side 58 and the second side 60. In the preferred embodiment, the length of the circumference of inner rim 64 is greater than the length of the circumference of rod 12 such that there is preferably a close-fitting relationship between inner rim 64 and the outer surface 29 of rod 12.

Collar 18 inner rim 64 and the outer surface 29 of rod 12 connect together. Collar 18 inner rim 64 is structured, shaped, and dimensioned to receive rod 12 first end 26 or second end 28 into and through aperture 66 of collar 18. Inner rim 64 is sized and dimensioned to provide translational movement of collar 18 along the length of rod 12. Inner rim 64 is sized and dimensioned to provide the rotational movement of collar 18 relative to rod 12 about the centerline of rod 12 when located along the length of rod 12. The collar 18 is positionable at any location along the length of the rod 12. The length of the perimeter of outer edge 62 of collar 18 is preferably equal to or less than the length of the perimeter of outer edge 52 of cymbal felt 16.

Collar 18 includes a locking mechanism 68 that fixes collar 18 at a desired location on rod 12. The fixed connection of collar 18 at a location on rod 12 limits the travel on rod 12 of the adjacent cymbal felt 16 and bell 14. Collar 18 locking mechanism 68 can have a permanent connection or an adjustable connection to rod 12. The adjustable connection of collar 18 can be connected to and disconnected from any location along the length of rod 12. The permanent connection of collar 18 to rod 12 can include, for example, methods of connection that are well known in the art such as welding, brazing, chemicals, adhesives, and mechanical devices that are commercially available devices known to fix a device such as collar 18 to rod 12 at a desired location along the length of rod.

In one preferred embodiment of collar 18, locking mechanism 68 has a collar connector 70 that includes a second collar aperture 72 and a collar screw 74. Second collar aperture 72 is a through hole that extends between outer edge 62 and inner rim 64. Second collar aperture 72 is preferably radially aligned with the center of inner rim 64. Second collar aperture 72 includes threads that are configured for mating with the threads of collar screw 74. The collar screw or screw 74 has a length suitable for extending through collar 18 outer edge 62 and inner rim 64. Collar screw 74 is structured to engage the outer surface 29 of rod 12 and securely fix collar 18 in position at a desired location on rod 12. It is understood that locking mechanism 68 in this one preferred embodiment can be facilitated by apertures, knurling, undulations, protuberances, and/or chemical treatments in or on outer surface 29 of rod 12 and/or inner rim 64 that can enhance the binding of the interface between locking mechanism 68 and rod 12.

Collar 18 is preferably fabricated of aluminum, but it is understood that collar 18 could be constructed of a broad range of materials suitable for connecting to rod 12 and limiting the travel of bell 14 to a desired location on rod 12 such as, but not limited to cellulose materials, metals, plastics, composites, and ceramics.

Figure 2B:
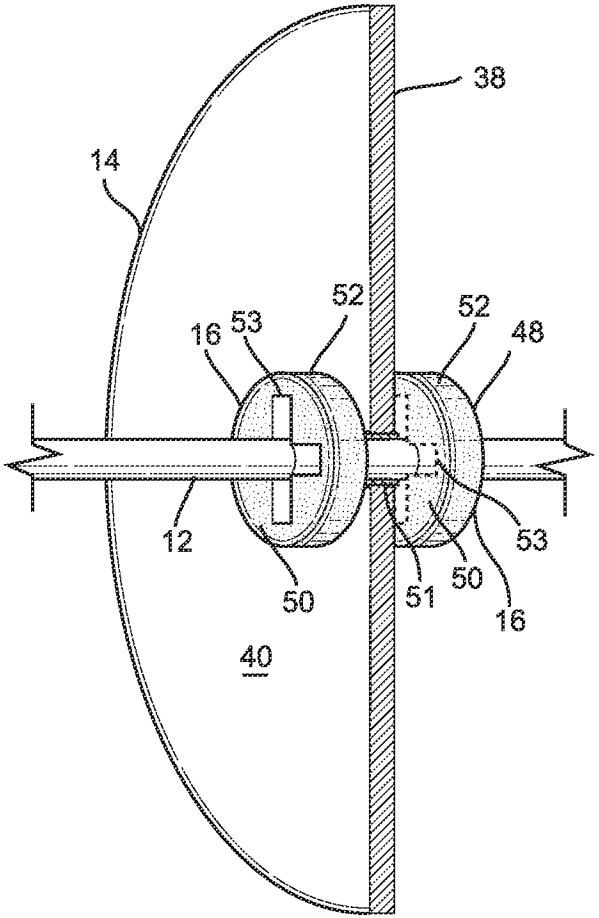
FIG. 2B is a first side perspective view of the Bell Music Instrument for Whirl Sound Effect of FIG. 1 showing an alternative embodiment of the cymbal felt.

Referring now to FIGS. 2A and 2B, in one preferred embodiment of bell music instrument 10, rod 12 further includes an extension 51. Extension 51 has a tubular shape and the inner wall of extension 51 is positioned around the outer surface 29 of rod 12 at a desired location on rod 12. Extension 51 has a thin structure suited for being located between outer surface 29 of rod 12 and inner rim 44 of bell 14. Extension 51 can be a separate structure or a part of or connected to one or both adjacent cymbal felts 16. The tubular structure of extension 51 fits between the outer surface 29 of rod 12 and the inner rim 44 of bell 14 without binding the free rotation or translation of bell 14. The layer added by extension 51 between the inner rim 44 of bell 14 and outer surface 29 of rod 12 isolates the sound of each bell 14 from rod 12 while minimizing any damping of bell 14. Extension 51 has a length that is at least equal to the thickness of inner rim 44 bell 14. Extension 51 is held in position by the cymbal felts 16 on the opposing sides 38 and 40 of bell 14. In one preferred embodiment extension 51 further includes elongate tabs 53 that connect to one or both of the two cymbal felts 16 by a fastener, such as a hook and loop type fastener, to secure the extension 51 and cymbals felts 16 into a single connected assembly located on the opposing sides 38 and 40 of bell 14. Extension 51 can, for example, extend between outer surface 29 of rod 12 and the inner rim 54 of cymbal felt 16 and rod 12 and connect to the first side 48 and/or second side 50 of cymbal felt 16. Alternatively, the tabs 53 can connect to the two collars 18 adjacent cymbal felts 16 on the opposing sides 38 and 40 bells 14.

Figure 3:
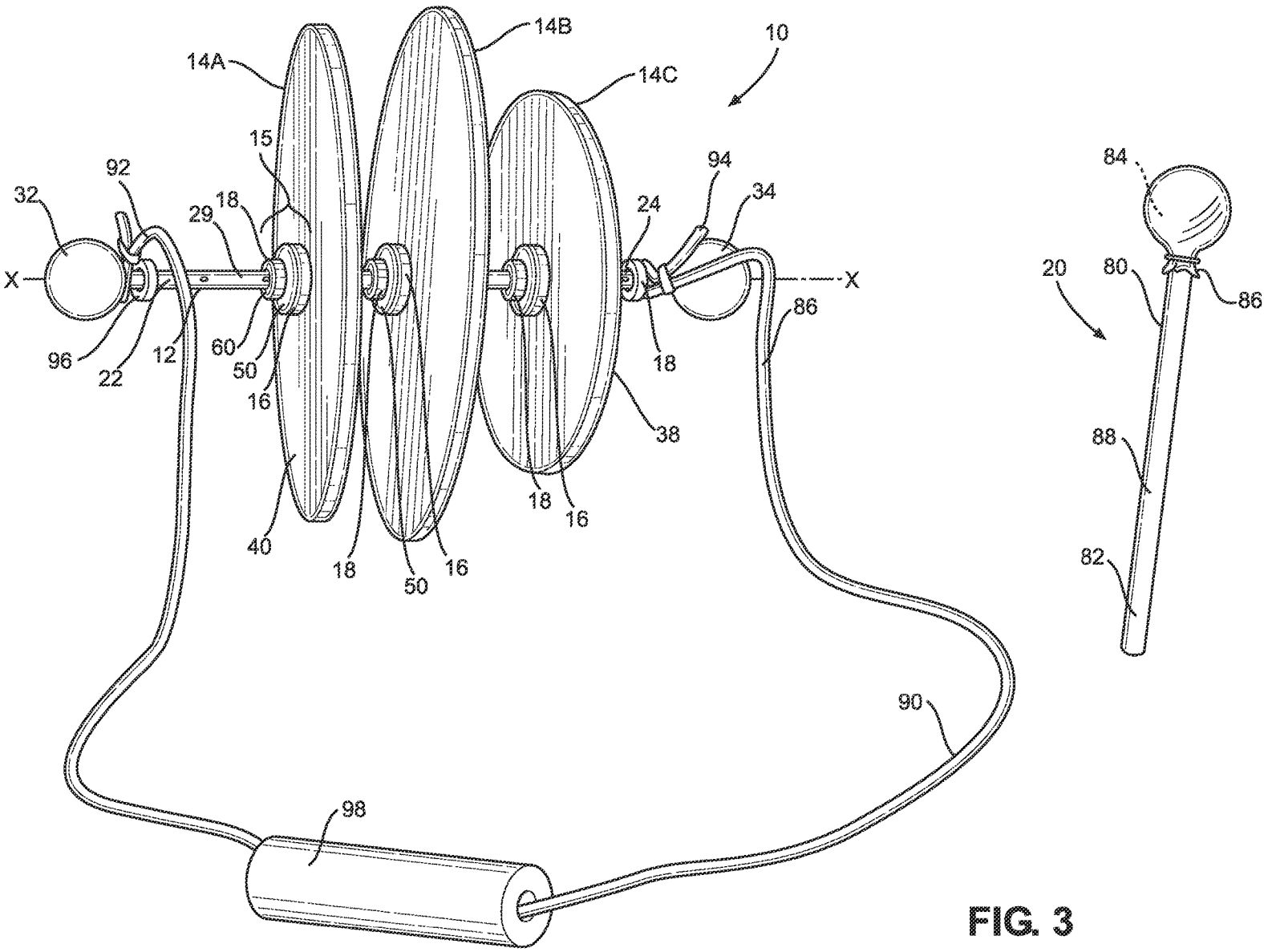
FIG. 3 is a front and second side perspective view of one embodiment of the Bell Music Instrument for Whirl Sound Effect of FIG. 1 with three bells in accordance with the present disclosure.

As shown in FIG. 3, bell music instrument 10 can include one or more bells 14. In this one preferred embodiment, bell music instrument 10 includes a ten (10) inch diameter bell 14A, an eleven (11) inch diameter bell 14B, and an eight (8) inch diameter bell 14C. Bells 14A, 14B, and 14C are located on rod 12 at distances from the midway point 30 that balance their respective weights from midway point 30. Alternatively, bell 14A and bell 14C can be located at visually symmetrical distances from midway point 30 on rod 12. It is understood that the one or more bells 14 of bell music instrument 10 can be positioned at any location along the length of rod 12.

Bell music instrument 10 in the preferred embodiment employs one pair of stops 15 with each of bells 14A, 14*b*, and 14C. Each stop 15 of the pair of stops 15 or two stops 15, preferably includes one cymbal felt 16 and one collar 18. A first stop 15 of the two stops 15 is located in close proximity to the first side 38 of each bell 14A, 14B, and 14C and a second stop 15 of the two stops 15 is located in close proximity to the second side 40 of each bell 14A, 14B, and 14C. It is understood that the relative proximity of stops 15 and bells 14 are dependent upon the application of bell music instrument 10 that include retaining the bells 14 in an approximately perpendicular alignment relative to the centerline of rod 12 or longitudinal axis-X and a desire to minimize the damping of bell 14.

Considerations for the different embodiments of hand-held bell music instrument 10 include the production of the desired pitch of each bell 14 and ease of manipulation. The one preferred embodiment shown in FIG. 3 produces a different pitch from bell 14A, bell 14B, and bell 14C based on their different diameters. The ease of the manipulation of bell music instrument 10 is enhanced by the low weight of the ten (10)inch diameter bell 14A at approximately two (2) pounds (lbs,), eleven (11) inch diameter bell 14B at approximately two and four tenths (2.4) lbs., and eight (8) inch diameter bell 14C at approximately one and one quarter (1.25) lbs.

Bell music instrument 10 can further include one or more mallets 20. Mallet 20 has a first end portion 80 and an opposed second end portion 82. The first end portion 80 includes a striker 84. Striker 84 is shown having a spherical shape, but it is understood that striker 84 can have any shape suitable for striking bell 14 such as for example cylindrical. Striker 84 is preferably made of rubber, polyethylene, nylon, or an acetal homopolymer, but it is understood that striker 84 can have alternative materials such as, for example, cellulose, hardened rubber, metal, polymer, or composite. In one preferred embodiment, mallet 20 is wood and a layer 86 of material such as felt or suede, at least partially encloses striker 84. Mallet 20 includes a handle 88 that connects to striker 84. Handle 88 facilitates the grasping of mallet 20 and the striking of bell 14.

Mallet 20 or hammer 20 is an optional component of bell music instrument 10. Mallet 20 is preferably a commercially available musical mallet structured for the striking of percussion instruments such as cymbals, xylophones, or bells, for example. Mallet 20 can also originate from another application and adapted for use with bell music instrument 10 and/or modified for use with bell music instrument 10. As defined herein the use of the term "a" or "an" such as for example as "bell," "a bell," or "the bell," while having a singular connotation can also refer to the plural or multiple bells 14.

Bell music instrument 10 can further include a line 90. Line 90 can be any type of flexible material that is suitable for supporting and manipulating bell music instrument 10. In one preferred embodiment line 90 is a commercially available cord or rope that can be fabricated of natural materials such as cotton, hemp, and/or synthetic materials such as nylon. Line 90 has a first end portion 92 and a second end portion 94. The first end portion 92 is preferably connected to the first end portion 22 of rod 12 and/or first handle 32 and the second end portion 94 is preferably connected to second end portion 24 of rod 12 and/or second handle 34. The connections between first end portion 92 and second end portion 94 to rod 12 can be, for example, the tying of line 90 into a knot directly around rod 12, the use of a mechanical fastener such as tie wrap to connect first end portion 92 and/or second end portion 94 around rod 12, a heat bond, and/or an adhesive. The connection between line 90 and rod 12 preferably accommodates the spinning rotation of rod 12 about the centerline of rod 12 relative to line 90.

Rod 12 can include an attachment device 96 which fixes the location of the connections of first end portion 92 and second end portion 94 to rod 12. In one preferred embodiment, attachment device % is one or more additional collars 18 that are located on rod 12 in close proximity to one another or in proximity, for example, to first handle 32 and/or second handle 34. Attachment device 96 can be the same collar 18 as in stop 15 or a different collar 18 as it is understood that collars 18 are commercially available connectors with multiple structures that can perform the functions defined herein.

Figure 6:
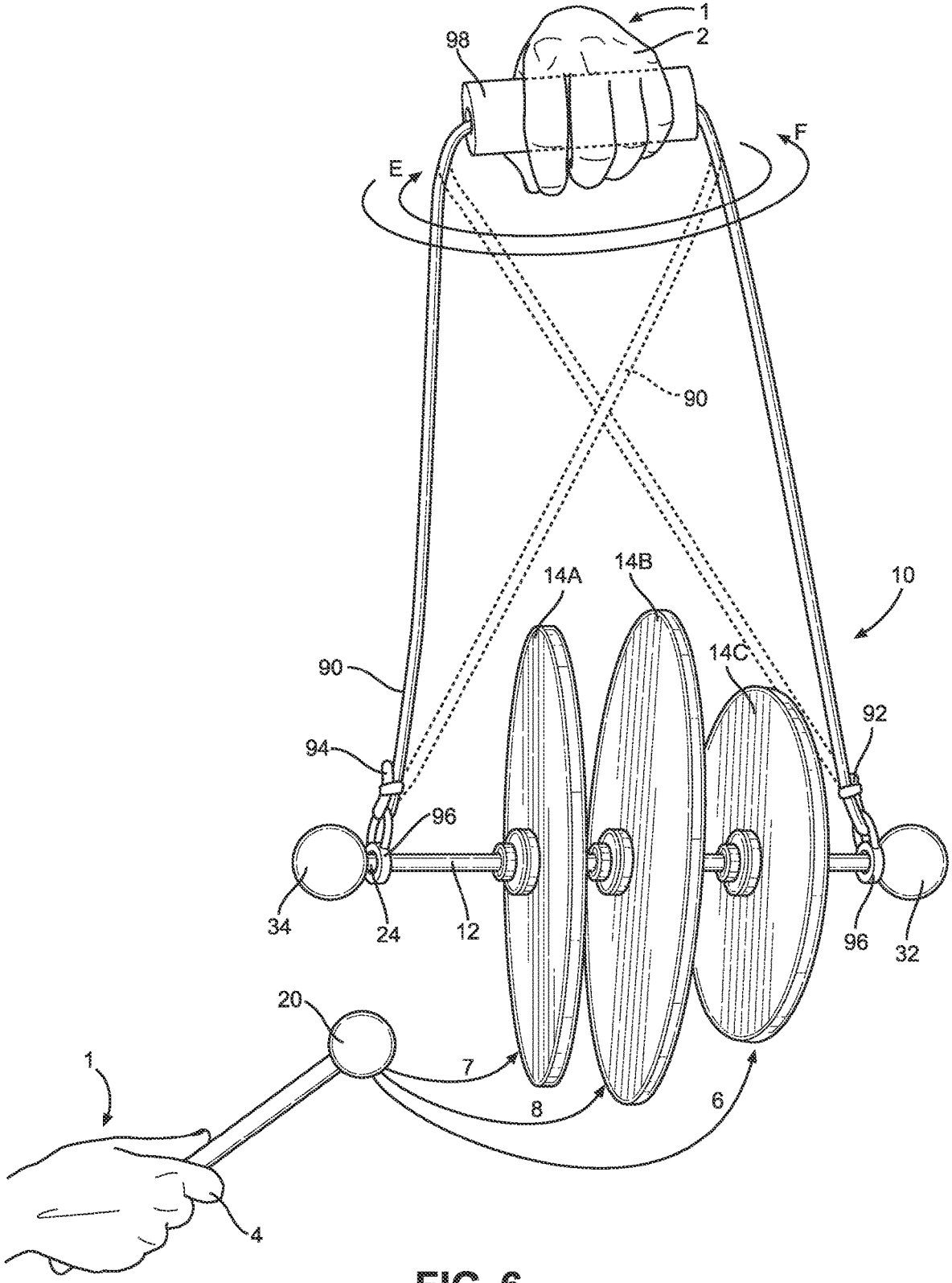
FIG. 6 is a front and second side perspective view of one embodiment of the Bell Music Instrument for Whirl Sound Effect of FIG. 1 with three bells in a third method of operational use in accordance with the present disclosure utilizing the line for movement.

Referring now to FIGS. 3 and 6, line 90 first end portion 92 is tied directly to rod 12 between attachment device % and first handle 32 and second end portion 94 is tied between exemplary collar 18, functioning as attachment device %, and second handle 34 on rod 12 second end portion 24. Alternatively, line 90 second end portion 94 can be tied directly to attachment device 96 that is preferably fixed on rod 12 on or in proximity to second handle 34. As described above, attachment device % and first handle 32 are preferably in fixed spaced separation to limit the translational travel of first end portion 92 and second end portion 94 on rod 12 while accommodating the free rotation of rod 12 relative to line 90. Similar attachment alternatives include tying second end portion 94 on rod 12 between two collars 18 or attachment devices 96 fixed in close spaced separation on rod 12. In this example, the spaced separation between the collars 18 provides a location for the connection of first end portion 92 and/or second end portion 94 to rod 12 that also bounds the travel of the connection between the collars 18 during the movement of bell music instrument 10. Line 90 can also be connected to fixed structures on the outer surface 29 of rod 12, handles 32 and/or 34, and collar 18 that facilitates attaching first end portion 92 and second end portion 94 to rod 12. Exemplary attachment devices 96 include a loop, T, or a hook structure, for example, which can act as an attachment point for the first end portion 92 and/or second end portion 94 on rod 12 that is preferably on or in proximity to first end portion 22 and second end portion 24.

Line 90 can further include a handle 98 that is preferably located at a central position between the first end 92 and second end 94. Handle 98 has a tubular shape and can be fixed in a location on line 90, slidable along line 90, and/or able to be fixed at multiple locations along the length of line 90. Handle 98 is preferably constructed of a material such as a rubber or polymer that is structured to facilitate gripping by a human hand. The surface of handle 98 can further include, for example, undulations, chemical treatments, knurling, and/or protuberances.

Referring now to FIGS. 1-3, one preferred method of assembling bell music instrument 10 includes interfacing and connecting the aperture 46 of bell 14 and the first end 26 of rod 12. Bell 14 is moved relative to rod 12 to the desired location of bell 14 on rod 12 which in this exemplary method is midway point 30 of rod 12. It is understood that each bell 14 of bell music instrument 10 is positionable at multiple locations on rod 12 and that each bell 14 preferably includes one pair of stops 15. The pair or stops 15 includes a first stop 15 and a second stop 15. The first stop 15 preferably includes a first cymbal felt 16 and a first collar 18 and the second stop 15 preferably includes a second cymbal felt 16 and a second collar 18.

The first end 26 of rod 12 and the first cymbal felt 16 interface and connect through aperture 56 defined by inner rim 54 of the first cymbal felt 16. First cymbal felt 16 is then moved relative to rod 12 to a location in close proximity to the first side 38 of bell 14. First cymbal felt 16 is preferably located on rod 12 with the second side 50 of first cymbal felt 16 in close proximity to the first side 38 of bell 14.

The second end 28 of rod 12 and second cymbal felt 16 interface and connect through aperture 56 defined by inner rim 54 of the second cymbal felt 16. Second cymbal felt 16 is then moved relative to rod 12 to a location in close proximity to the second side 40 of bell 14. Second cymbal felt 16 is preferably located on rod 12 with the first side 48 of second cymbal felt 16 in close proximity to the second side 40 of bell 14. While the inclusion of cymbal felt 16 in each of the stops 15 of the two stops 15 is optional, the preferred embodiment of the bell music instrument 10 includes one pair of stops 15 or an equivalent thereof for each bell 14.

Continuing with the preferred method of assembling bell of music instrument 10, collars 18 of the pair of stops 15 are connected to rod 12 and located in close proximity to cymbal felts 16 on the opposing sides of bell 14.

The first end 26 of rod 12 and the first collar 18 interface and connect through aperture 66 defined by inner rim 64 of first collar 18. First collar 18 is then moved relative to rod 12 to a location in close proximity to the first side 48 of first cymbal felt 16. First collar 18 is preferably located on rod 12 with the second side 60 of first collar 18 in close proximity to the first side 48 of first cymbal felt 16.

The second end 28 of rod 12 and second collar 18 interface and connect through aperture 66 defined by inner rim 64 of the second collar 18. Second collar 18 is then moved relative to rod 12 to a location in close proximity to the second side 50 of second cymbal felt 16. Second collar 18 is preferably located on rod 12 with the first side 58 of second collar 18 in close proximity to the second side 50 of second collar 16.

As shown in FIGS. 2A and 3, in one preferred embodiment of bell music instrument 10, the first side 38 and second side 40 of bell 14 are approximately aligned perpendicular to the centerline of rod 12. The inner rim 44 of bell 14 provides a close-fitting connection with the outer surface 29 of rod 12. The shape of inner rim 44 and close-fitting relationship of inner rim 44 with rod 12 can contribute to limit the angular travel of bell 14 from the perpendicular alignment relative to centerline of rod 12. It is understood, however, that the interface between inner rim 44 of bell 14 and the outer surface 29 of rod 12 can vary depending upon the intended application. For example, variations in the diameter and shape of the surface of inner rim 44 and/or outer surface 29 of rod 12 can facilitate the angular movement or limit the angular movement of bell 14 from the perpendicular relative to the centerline of rod 12.

The spacing between the pairs of cymbal felts 16 and pairs of collars 18 and the first side 38 and second side 40 of each bell 14 can be varied depending upon the desired application to minimize any damping of bell 14 and a desired degree of angular and/or translational movement of each bell 14 relative to rod 12. In the preferred embodiment, each bell 14 is retained in a substantially perpendicular alignment relative to the centerline of rod 12 by one of the pairs of cymbal felts 16 and collars 18 in combination with the close-fitting connection between the outer surface 29 of rod 12 and inner rim 44 of bell 14.

Stop 15 provides structural support for the alignment and limits the translational movement of bells 14. Stop 15 can include other known devices such as a spring separately or in combination with cymbal felt 18 or collar 18. While the tonal quality of bell music instrument 10 without cymbal felts 16 has been shown to be adequate, testing has demonstrated a better and more consistent tonal quality with cymbal felts 16 than the sound of the bell music instrument 10 without cymbal felts 16. Additional benefits can include a reduction in the metal-to-metal wear between bell 14 and collar 18.

Figure 4A:
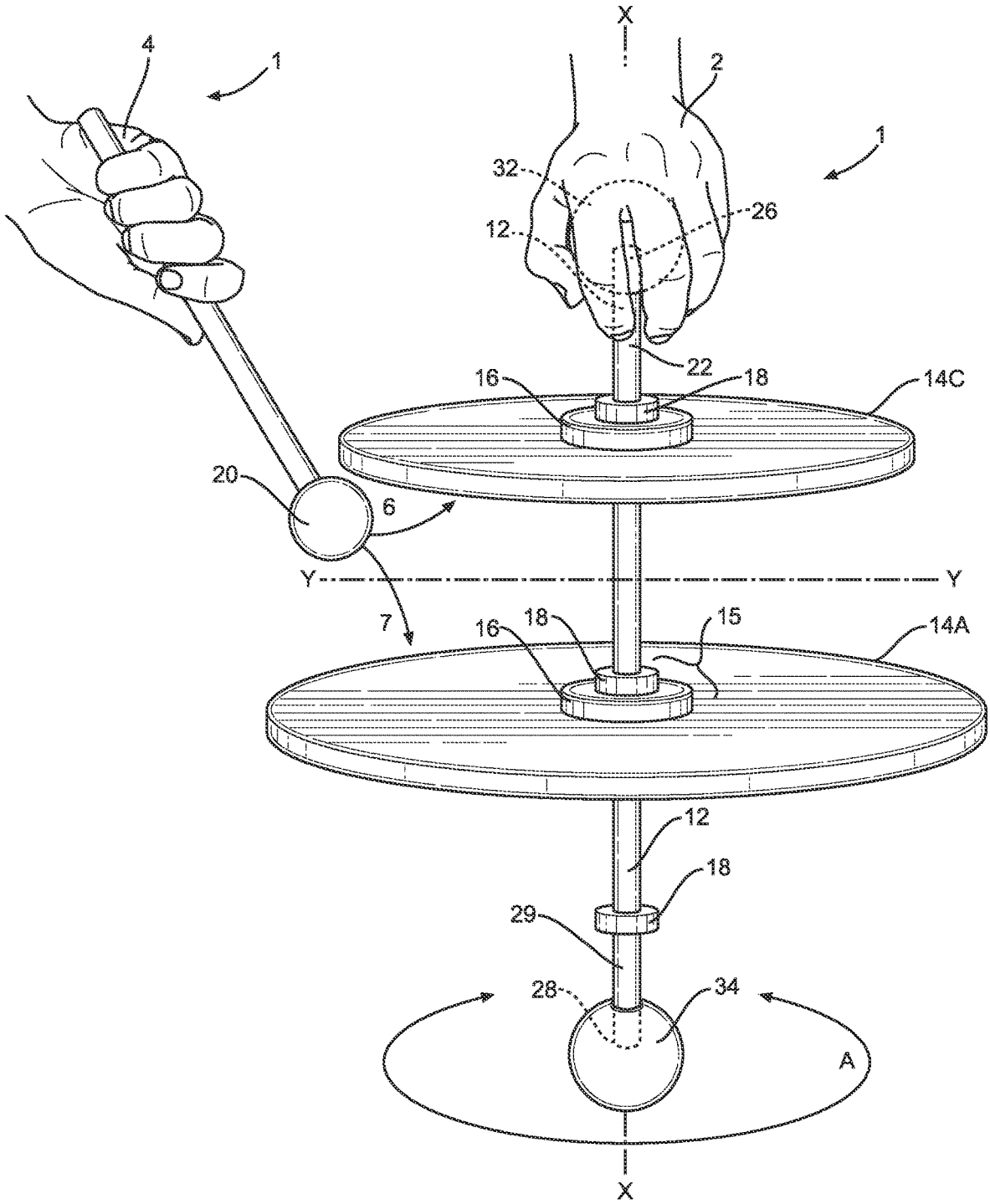
FIG. 4A is a frontal and second side perspective view of one embodiment of the Bell Music Instrument for Whirl Sound Effect of FIG. 1 with two bells in a first method of operational use in accordance with the present disclosure.

As shown in FIGS. 3 and 4A, rod 12 can include collar 18 located in proximity and fixed spaced relation to second handle 34. The space or gap along the outer surface 29 of rod 12 between second handle 34 and the collar 18 in proximity to handle 34 is suitable for the connecting of line 90 to rod 12. The options for connecting line 90 and rod 12 include the manual tying of line 90 first end portion 92 in a knot around rod 12. Alternatively, for example, line 90 is looped around rod 12 and line 90 and first end portion 92 are connected together using a secure fastener such as a zip tie or other forms of a connector. The space or gap between the location of the collar 18 and/or line attachment device 96 on rod 12 and first handle second handle 34 in this example limits the translational travel of the attachment of line 90 to rod 12 while preserving the rotation of rod 12 while attached to line 90.

Referring now to FIGS. 4A-6, the operational use of bell music instrument 10 includes the creative movement of the ringing bell 14 of bell music instrument 10 relative to the audience. It is understood that the initial positions described in FIGS. 4A-6 are for the convenience of a player 1 of bell music instrument 10 and that bell music instrument 10 can be initially held or set in a support stand or fixture suitable for holding bell music instrument 10 having any angular alignment.

The initial positions of bell music instrument facilitate the holding, striking, and initial ringing pitch of bell 14. Bell music instrument 10 is preferably handheld throughout the ringing and playing of bell music instrument 10. First end portion 22, second end portion 24, and handles 32, 34, and 98 are preferably made of materials, coatings, and/or have a shape that facilitates the grasping, manipulating, holding, and moving of bell music instrument 10 through movements in two-dimensional and three-dimensional space. Bell 14 is preferably rung by the strike of a finger, sharp tap of a hand, or the use of an object such as mallet 20 by a player 1, another player, or the striking of bell 14 against a structure that will ring bell 14. Similarly, the uses of a first hand 2 of player 1, a second hand 4 of player 1, the hand of another, and/or the ringing of bell 14 by striking bell 14 against an object is considered to be interchangeable in any of the steps of the different methods described herein.

As shown in FIG. 4A, bell music instrument 10 in this one preferred exemplary embodiment includes bell 14A and bell 14C. Bell music instrument 10 is shown in a first position of a method of playing bell music instrument 10 that includes player 1 first hand 2 holding first handle 32 and/or rod 12 first end portion 22 in a first position such that bell music instrument 10 is hanging freely downward with longitudinal axis-X in a vertical alignment and second end portion 24 of rod 12 hanging freely downward. Bell 14A and bell 14C, or bells 14A and 14C, are approximately aligned with an axis-Y that is perpendicular to axis-X. It is understood that bell music instrument 10 can be held in the first position using either first hand 2, second hand 4 and/or a fixture (not shown) that supports bell music instrument 10 and allows the exemplary bells 14A and 14C to be rung simultaneously or sequentially. Stops 15, in this embodiment include cymbal felt 16 and collar 18 retain bells 14A and 14C in their respective locations on rod 12. One additional collar 18 is shown located on rod 12 in fixed spaced separation from second handle 34.

The first method of playing the bell music instrument 10 includes positioning bell music instrument 10 in the first position as described above and the second hand 4 of player 1 second hand 4 preferably uses mallet 20 to strike and ring bell 14C as shown by Arrow-6 and strike and ring bell 14A as represented by Arrow-7 to create two different pitches overlaying one another. The ringing of bells 14A and 14C creates a crisp, distinctly different, and harmonious pitch combination having an extended duration. This initial step can also establish individual pitch baselines of bells 14A and 14C. Player 1 first hand then 2 rotates first end 26 and/or first handle 32 in a fixed or approximately fixed location in space such that rod 12 second end 28 and/or second handle 34 is moving, as shown by Arrow-A, in a circle while bells 14A and 14C are ringing. The circular motion of second end 28 is in a plane that is approximately perpendicular to the vertically aligned plane defined by the Axis-X and Axis-Y. The circular movement of second end 28 also moves rod 12 in a conical shape and produces a whirl sound effect by as bells 14A and 14C are simultaneously ringing.

Figure 4B:
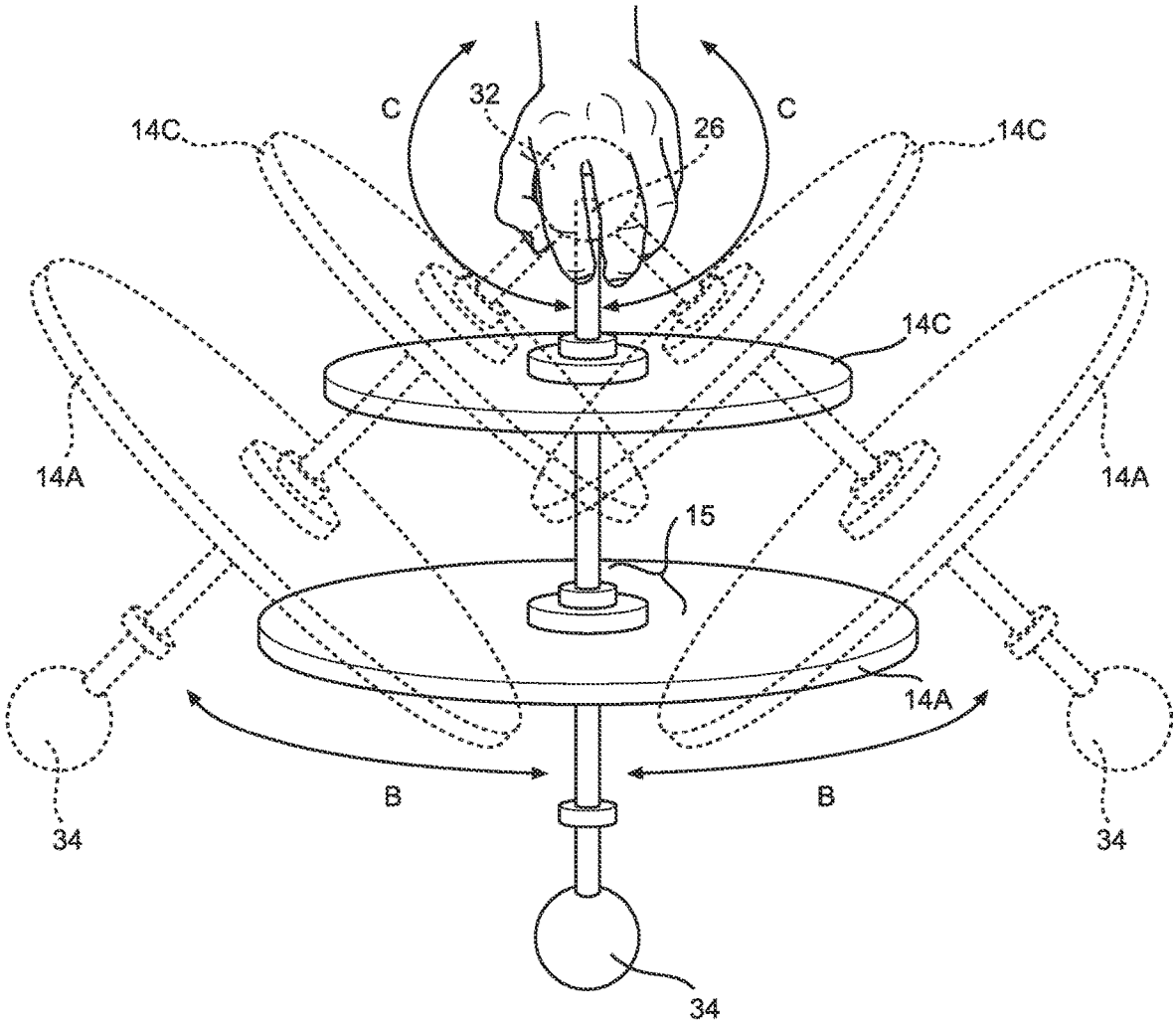
FIG. 4B is a frontal and second side perspective view of the embodiment of the Bell Music Instrument for Whirl Sound Effect of FIG. 4A with two bells in a second and a third method of operational use in accordance with the present disclosure.

Referring now to FIGS. 4A and 4B, a second method of playing the bell music instrument 10 includes initially ringing bells 14A and 14C in the first position as described above. Player 1 first hand 2 then rotates first end 26 and/or first handle 32 in a fixed or approximately fixed location in space while rotating first end 26 and/or first handle 32 to swing second end portion 24 in an arc within a vertically aligned plane defined by longitudinal axis-X and axis Y. This includes player 1 rotating first end 26 in a fixed position to swing second end portion 24 in an arc for an arc such as, for example, for approximately thirty degrees (30°) to approximately forty-five degrees (45°) from the first position of the second end portion 24 between Arrows-B. As required, player 1 second hand 4 can further assist rod 12 first hand 2 in the rotation of bell music instrument 10. In this example, bell music instrument 10 can be rotated as described above in an are of up to approximately one-hundred eighty degrees (180°) or more in the vertical plane as shown by Arrow-B. The methods of playing bell music instrument 10 can include the ringing of bells 14A and 14C multiple times prior to and/or throughout the duration of the method of playing of bell music instrument 10.

In the above methods of playing bell music instrument 10, the apparent change in the frequency of the sound waves or pitch of ringing bells 14A and 14C is produced by the relative two-dimensional and three-dimensional movement of ringing bells 14A and 14C between ringing bells 14A and 14C of bell music instrument 10 and the audience. The audience as defined herein is a listener or listeners of the whirl sound effect produced by the ringing bell 14 of bell music instrument 10.

Figure 5A:
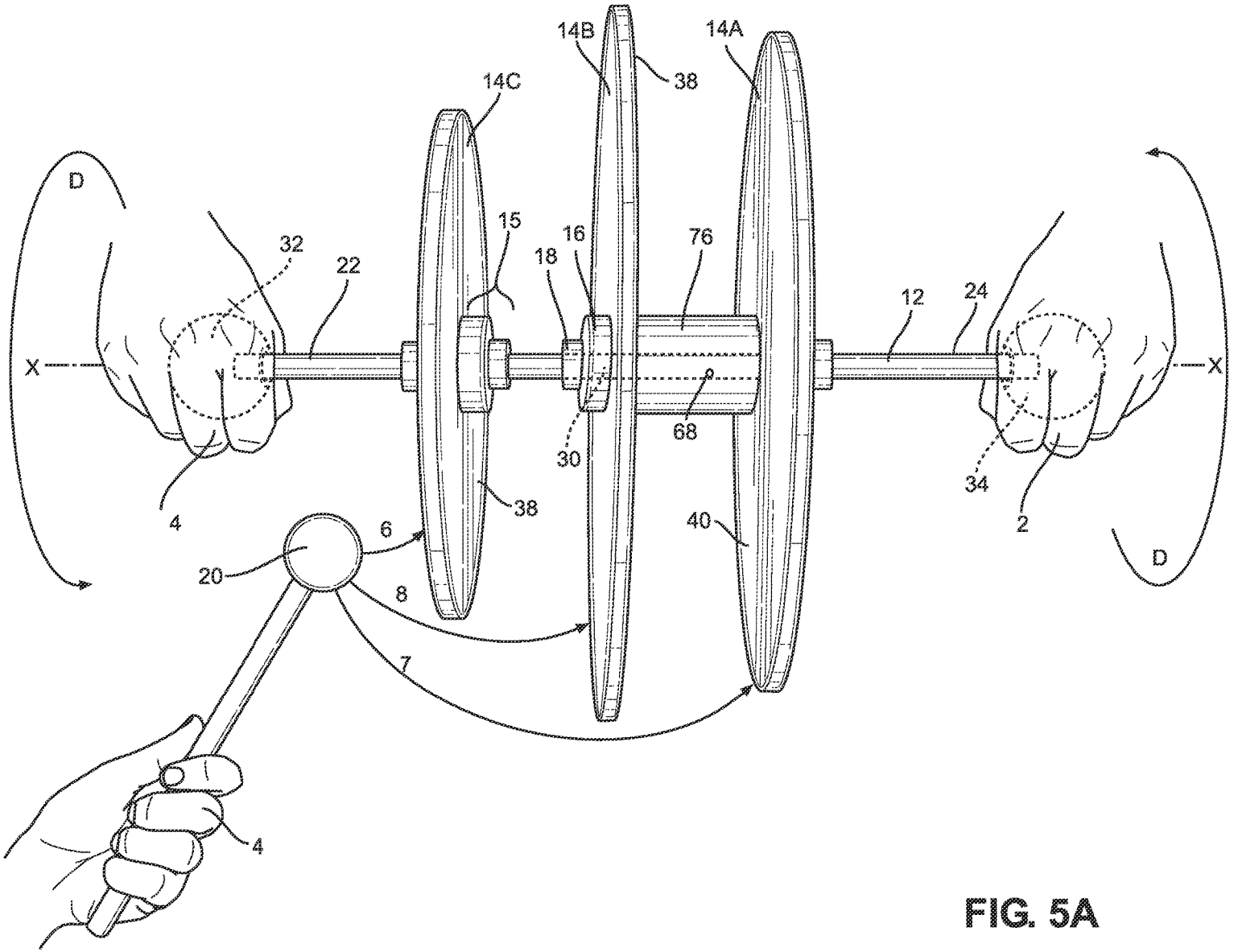
FIG. 5A is a frontal view of one embodiment of the Bell Music Instrument for Whirl Sound Effect of FIG. 1 with three bells in a fourth method of operational use in accordance with the present disclosure.
Figure 5B:
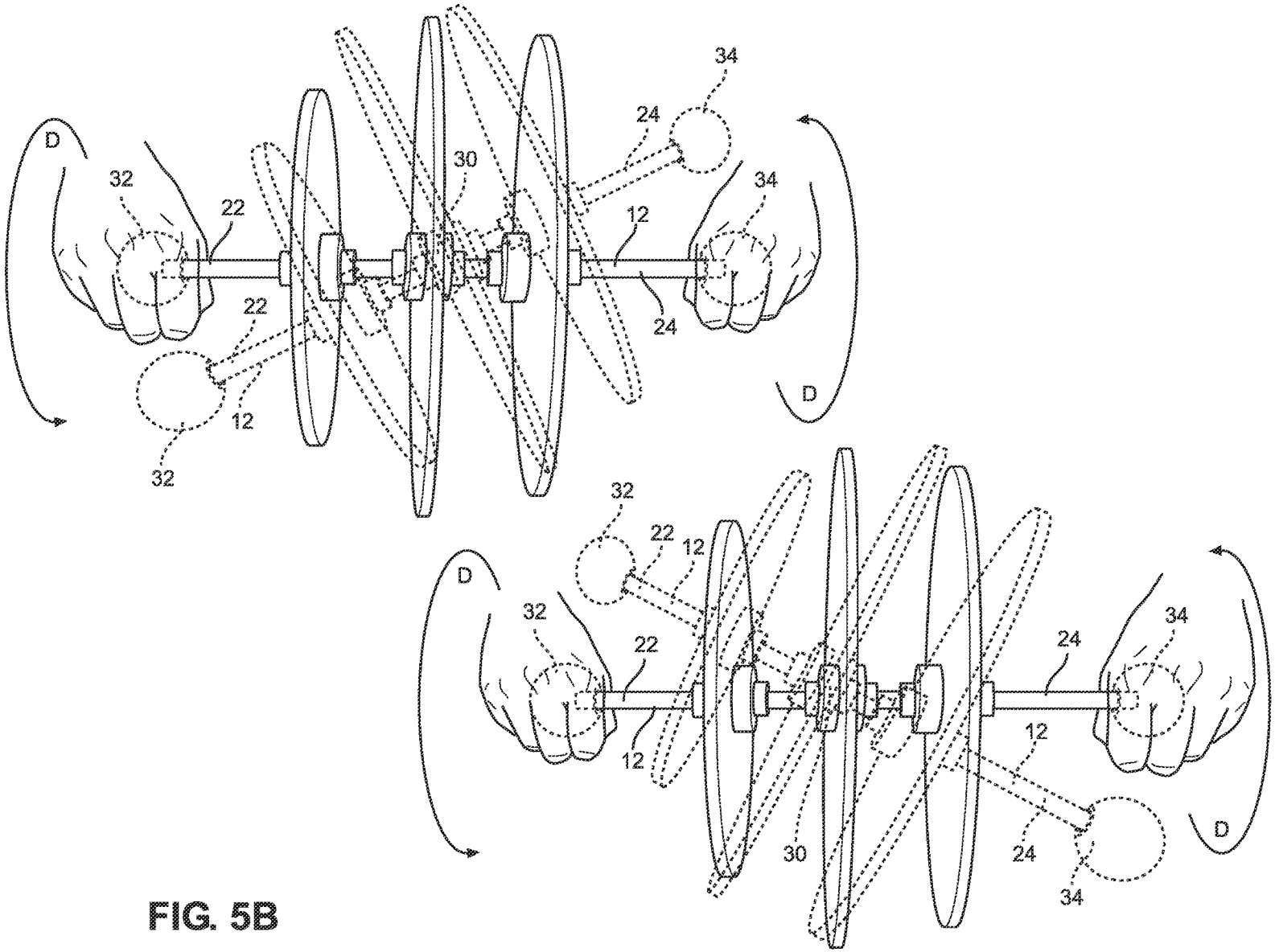
FIG. 5B is a frontal view of the embodiment of the Bell Music Instrument for Whirl Sound Effect of FIG. 5A with three bells in the fourth method of operational use in accordance with the present disclosure.

Referring now to FIGS. 5A and 5B, player 1 initially holds bell music instrument 10 with first hand 2 on second handle 34 of rod 12 and second hand 4 on first handle 32. As shown, second hand 4 releases handle 32, grasps mallet 20, strikes bells 14A, 14B, and 14*c* as shown by Arrow-7, Arrow-8, and Arrow-6, respectively, and then returns to hold first handle 32. It is understood that the striking of bells 14A, 14*b*, and 14C can be done in any order with alternatives to mallet 20 as described previously that include striking bells 14A, 14*b*, and 14C with hands 2 or 4, the fingers or fingernails of hands 2 or 4 and/or a rod made of alternative materials. The striking of bell 14C, bell 14B, and bell 14A creates three different crisp rings each with their own pitch overlaying one another for an extended duration in a harmonious combination.

The first end portion 22 and second end portion 24 of rod 12 of bell music instrument 10 are then moved in circular motions about midway point 30 of rod 12 as shown by Arrows-D such that, for example, first end portion 22 is an upper point of the circular rotation when second end portion 24 is in the lower point of its circular rotation and rod 12 is angled between at an approximately thirty-degree (30°) to approximately forty-five degree (45°) angle. The three-dimensional rotational movement of bells 14A, 14B, and 14C about midway point 30 as shown by Arrows-D create the whirl sound effect in the pitch of bells 14A, 14B, and 14C.

Stop 15 can have different structures that include the integration of collar 18 and cymbal felt 16 into a single component. Stop 15 can be a different application of first handle 32, second handle 34, and/or a tubular structure similar to line 90 handle 98. In one preferred embodiment of collar 18, a shared handle 76 is located between bell 14A and bell 14B that is the equivalent of two stops 15 and has a tubular structural shape similar to that of line 90 handle 98. Shared handle 76 can include a locking mechanism 68 that fixes shared handle 76 at a location on rod 12 as described above for collar 18. Shared handle 76 can be fixed at a location on rod 12 such as adjacent to first side 38 of bell 14 and function as a collar 18 and/or stop 15. Shared handle 76 can have alternative dimensions, shapes, and structures from that of collar 18 and/or line handle 98. Alternative structures and shapes of shared handle 76 include a spherical shape such as that of first handle 32 and include the addition of cymbal felt 16. In this exemplary embodiment of stop 15, shared handle 76 preferably has the material, structure, and functions of stop 15 without the addition of a separate cymbal felt 16.

In this one preferred embodiment, shared handle 76 is located and fixed on rod 12 directly between bell 14A and bell 14B. In this arrangement, shared handle 76 replaces the individual stops 15 positioned adjacent bell 14B first side 38 and bell 14A second side 40. The structure of shared handle 76 in this one exemplary preferred embodiment is tubular, similar to that of line 90 handle 98, but is the structural and functional equivalent of stop 15 and/or collar 18. Shared handle 76 can be connected to and fixed at a location on the outer surface 29 of rod 12 using locking mechanism 68 or a similar device as described previously for collar 18. Shared handle 76 can also function as a spacer between bells 14A and 14B. This embodiment can include the shared handle 76 having material characteristics that enable shared handle 76 to function as both collar 18 and cymbal felt 16. Alternatively, shared handle 76 can be used with two (2) cymbal felts 16 as described herein.

As shown in FIG. 6 in a preferred method of playing bell music instrument 10, player 1, initially holds bell music instrument 10 with first hand 2 on handle 98 of line 90. Line 90 is connected to rod 12 in this one preferred embodiment by connecting to line attachment devices 96. First end portion 92 and second end portion 94 of line 90 connect to line attachment devices 96 at fixed locations on rod 12. In this one preferred embodiment, attachment devices 96 are located in proximity to and in fixed spaced separation from first handle 32 and second handle 34, respectively, as previously described with reference to FIGS. 3 and 4. As noted earlier, handles 32 and 34 are optional and bell music instrument 10 can be manipulated solely by the connection of line 90 to rod 12 or by directly manipulating rod 12.

Second hand 4 preferably uses mallet 20 to strike and ring bells 14A, 14B, and 14C as described previously in FIG. 5. Player 1 hand 2 rotates line 90 handle 98 of bell music instrument 10 approximately one-hundred and eighty degrees (180°) as shown in Arrow-E and then allows bell music instrument 10 to unwind as shown by Arrow-F to create another whirl sound effect by the relative movement of ringing bells 14A, 14B, and 14C. In this embodiment, bell music instrument 10 can be rotated by winding in a single plane, such as the horizontal for example, as well as by moving the angle of the rotation through multiple planes transverse to the horizontal plane.

Continuing with FIG. 6, player 1 holds bell music instrument 10 with first hand 2 on handle 98 as described above, but line 90 of bell music instrument 10 is wound in the direction of Arrow-E one or more three-hundred and sixty-degree (360) rotations and then held in a wound position. The holding of bell music instrument 10 in the wound position can include, for example, holding the wound line 90 with second hand 4 and/or positioning rod 12, first handle 32 and/or second handle 34 against an object and/or a part of player 1 to prevent the unwinding of bell music instrument 10. Second hand 4 then strikes and rings bells 14A, bell 14B, and bell 14C with mallet 20 as shown with Arrow-7, Arrow-8, and Arrow-6, respectively and then bell music instrument 10 is released to unwind bell music instrument 10 from the wound position as shown by Arrow-F to create another alternative form of the whirl sound effect. In this exemplary method as well as the above, one or more of the bells 14 of the bell music instrument 10 can be rung again while moving to extend and/or vary the apparent sound of the moving one or more bells 14 for the creation of the whirl sound effect.

In the preceding specification, the present disclosure has been described with reference to specific exemplary embodiments thereof. It will be evident, however, that various modifications, combinations, and changes may be made thereto without departing from the broader spirit and scope of the invention as set forth in the claims that follow. For example, first hand 2 or second hand 4 of player 1 can be positioned in proximity to any one or more of bells 14 to selectively attenuate the ringing of any one or more of bells 14. While the present disclosure is described in terms of a series of embodiments, the present disclosure can combine one or more novel features of the different embodiments.

The specification and drawings are accordingly to be regarded in an illustrative manner rather than a restrictive sense.

The invention claimed is:

1. A bell music instrument structured for creating a whirl sound effect, the bell music instrument comprises:

a rod, the rod has a solid cylindrical shape, the rod has a first end portion and an opposed second end portion, the first end portion includes a first terminal end and the second end portion includes a second terminal end, the rod defines a length between the first terminal end and the second terminal end, the first terminal end and the second terminal end are the opposing terminal ends of the rod, the cylindrical shape of the rod defines an outer surface of the rod, the outer surface of the rod defines a circumference of the rod, the outer surface of the rod extends the length of the rod, the cylindrical shape of the rod defines a center of the circumference and a centerline of the rod, the centerline of the rod extends the length of the rod;

a bell, the bell has a disc shape, the bell includes a first side and a second side, the first side and the second side are opposing sides, the bell includes an outer rim and an inner rim, the outer rim is connected to the first side and the second side, the outer rim defines an outer circumference of the bell, the inner rim is connected to the first side and second side, the inner rim defines an inner circumference of the bell, the inner rim has a length, the inner rim defines an aperture in the bell, the aperture is a through hole that extends between the first side and the second side, the aperture is aligned perpendicular to the disc shape of the bell, the inner rim defines a center of the aperture, the length of the inner rim is greater in than the length of the circumference of the rod, the bell and rod are connected, the connection of the bell and rod includes the interfacing of the inner rim of the bell and outer surface of the rod, the inner rim of the bell having a close-fitting relationship with the outer surface of the rod, the connected bell and rod includes the bell being movable along the length of the rod and relative to the rod, the bell is positioned at a location on the outer the outer surface of the rod, the connected bell and rod includes the bell having rotational movement about the centerline of the rod and relative to the rod; and a pair of stops, each stop of the pair of stops or each stop connects to the rod, each stop interfaces with and is located on the outer surface of the rod, each stop has translational movement along the length of the rod and relative to the rod, each stop is rotatable about the centerline of the rod and relative to the rod, the pair of stops includes a first stop and a second stop, the first stop is located on and fixed at a location on the outer surface of the rod in proximity to the first side of the bell, the second stop is located on and fixed at a location on the outer surface of the rod in proximity to the second side of the bell, the first stop and the second stop retain the bell at the location on the outer surface of the rod between the first stop and the second stop, the first stop and second stop accommodate the rotational movement of the bell about the centerline of the rod and relative to the rod, the first stop in fixed spaced separation on the rod relative to the second stop.

2. The bell music instrument of claim 1 wherein the bell includes two or more bells, a first bell has a first outer rim and a second bell has a second outer rim, the first outer rim has a length and the second outer rim has a length, the length of the second outer rim is different from the length of the first outer rim, each bell of the two or more bells has the first stop located in proximity to the first side of the bell and the second stop located in proximity to the second side of the bell, the first stop is in fixed spaced relation to the second stop, the first stop and the second stop limit the transverse travel of each bell of the two or more bells on the rod.

3. The bell music instrument of claim 1, wherein each stop includes a collar, the collar has an annular structure with an inner rim, the inner rim defines an aperture, the inner rim and outer surface of the rod interface, the collar inner rim located on the outer surface of the rod through the aperture of the collar, the inner rim of the collar has a close-fitting relationship with the outer surface of the rod, a first collar located on the outer surface of the rod in proximity to the first side of the bell and a second collar located on the outer surface of the rod in proximity to the second side of the bell, the first collar in fixed spaced separation on the rod from the second collar.

4. The bell music instrument of claim 1, wherein each stop includes a collar and a cymbal felt, the collar has an annular structure that defines an inner rim, the inner defines an aperture, the cymbal felt has an annular structure that defines an inner rim, the cymbal felt inner rim defines an aperture, the outer surface of the rod and the inner rim of the collar and inner rim of the cymbal felt interface and are connected, the inner rims of the collar and cymbal felt have a close fitting relationship with the outer surface of the rod, a first cymbal felt located on the outer surface of the rod in close proximity to the first side of the bell and a second cymbal felt located on the outer surface of the rod in close proximity to the second side of the bell, a first collar located on the outer surface of the rod in close proximity to the first cymbal felt, a second collar located on the outer surface of the rod in close proximity to the second cymbal felt, the first cymbal felt located between the first side of the bell and the first collar and the second cymbal felt located between the second side of the bell and the second collar, the first collar and the second collar at a fixed location on the outer surface of the rod in proximity to the first side of the bell and the second side of the bell, the first collar located in fixed spaced separation on the rod from the second collar.

5. The bell music instrument of claim 1 wherein the bell is a solid cast piece of MIC-6 aluminum.

6. The bell music instrument of claim 1 wherein the bell music instrument includes at least three bells, a first bell having a first diameter, a second bell having a second diameter, and a third bell having a third diameter, the first diameter, second diameter, and third diameter are different diameters.

7. The bell music instrument of claim 1 further comprising a mallet.

8. The bell music instrument of claim 1 further comprising a first handle connected to the first end portion of the rod and a second handle connected to the second end portion of the rod.

9. The bell music instrument of claim 1 that further includes a line, the line connected to the rod.

10. The bell music instrument of claim 1, wherein the stop is a shared handle and the shared handle functions as a stop between two adjacent bells.

11. The bell music instrument of claim 1, wherein and the first side and the second side of the bell are planar.

12. A bell music instrument structured for creating a whirl sound effect, the bell music instrument comprises:

a rod, the rod has a solid cylindrical shape, the rod has a first end portion and an opposed second end portion, the first end portion includes a first terminal end and the second end portion includes a second terminal end, the rod defines a length between the first terminal end and the second terminal end, the first terminal end and the second terminal end are the opposing terminal ends of the rod, the cylindrical shape of the rod defines an outer surface of the rod, the outer surface of the rod defines a circumference of the rod, the outer surface of the rod extends the length of the rod, the cylindrical shape of the rod defines a center of the circumference and a centerline of the rod, the centerline of the rod extends the length of the rod;

a bell, the bell has a disc shape, the bell includes a first side and a second side, the first side and the second side are opposing sides, the bell includes an outer rim and an inner rim, the outer rim is connected to the first side and the second side, the outer rim defines an outer circumference of the bell, the inner rim is connected to the first side and second side, the inner rim defines an inner circumference of the bell, the inner rim has a length, the inner rim defines an aperture in the bell, the aperture is a through hole that extends between the first side and the second side, the aperture is aligned perpendicular to the disc shape of the bell, the inner rim defines a center of the aperture, the length of the inner rim is greater in than the length of the circumference of the rod, the bell and rod are connected, the connection of the bell and rod includes the interfacing of the inner rim of the bell and outer surface of the rod, the inner rim of the bell having a close-fitting relationship with the outer surface of the rod, the connected bell and rod includes the bell being movable along the length of the rod and relative to the rod, the bell is positioned at a location on the outer the outer surface of the rod, the connected bell and rod includes the bell having rotational movement about the centerline of the rod and relative to the rod; and a pair of collars, each collar of the pair of collars or each collar connects to the rod, each collar interfaces with and is located on the outer surface of the rod, each collar has translational movement along the length of the rod and relative to the rod, each collar is rotatable about the centerline of the rod and relative to the rod, the pair of collars includes a first collar and a second collar, the first collar is located on and fixed at a location on the outer surface of the rod in proximity to the first side of the bell, the second collar is located on and fixed at a location on the outer surface of the rod in proximity to the second side of the bell, the first collar and the second collar retain the bell at the location on the outer surface of the rod between the first collar and the second collar, the first collar and second collar accommodate the rotational movement of the bell about the centerline of the rod and relative to the rod, the first collar located on the rod in fixed spaced separation relative to the location on the rod of the second stop.

13. The bell music instrument of claim 12 wherein the bell music instrument further includes a pair of cymbal felts, each cymbal felt of the pair of cymbal felts or each cymbal felt connects to the rod, each cymbal felt interfaces with and is located on the outer surface of the rod, each cymbal felt has translational movement along the length of the rod and relative to the rod, each cymbal felt is rotatable about the centerline of the rod and relative to the rod, the pair of cymbal felts includes a first cymbal felt and a second cymbal felt, the first cymbal felt is located on the outer surface of the rod adjoining the first side of the bell and adjoining the first collar, the second cymbal felt is located on the outer surface of the rod adjoining the second collar and adjoining the second side of the bell, the first cymbal felt and second cymbal felt accommodate the rotational movement of the bell about the centerline of the rod and relative to the rod.

14. The bell music instrument of claim 13 wherein the first cymbal felt and the second cymbal felt are located adjoining the opposing sides of the bell are connected by an extension, the extension at least partially overlays the rod and extends between the outer surface of the rod and the inner rim of the bell.

15. The bell music instrument of claim 12 wherein the opposing sides of the bell are planar.

16. The bell music instrument of claim 12 wherein the first collar and the second collar retain the bell at an angle approximately perpendicular to the centerline of the rod.

17. The bell music instrument of claim 12 wherein each collar of the pair of collars is at least partially enclosed by a cymbal felt.

18. The bell music instrument of claim 12 that further includes a line, the connected to the rod.

19. The bell music instrument of claim 12 that further includes a mallet.

20. A method of playing a bell music instrument, the bell music instrument, the bell music instrument structured for moving and creating a whirl sound effect, the method of playing the bell music instrument comprising:

providing a bell music instrument, the bell music instrument including a rod, the rod has a solid cylindrical shape, the rod has a first end portion and an opposed second end portion, the first end portion includes a first terminal end and the second end portion includes a second terminal end, the rod defines a length between the first terminal end and the second terminal end, the first terminal end and the second terminal end are the opposing terminal ends of the rod, the cylindrical shape of the rod defines an outer surface of the rod, the outer surface of the rod defines a circumference of the rod, the outer surface of the rod extends the length of the rod, the cylindrical shape of the rod defines a center of the circumference and a centerline of the rod, the centerline of the rod extends the length of the rod;

a bell, the bell has a disc shape, the bell includes a first side and a second side, the first side and the second side are opposing sides, the bell includes an outer rim and an inner rim, the outer rim is connected to the first side and the second side, the outer rim defines an outer circumference of the bell, the inner rim is connected to the first side and second side, the inner rim defines an inner circumference of the bell, the inner rim has a length, the inner rim defines an aperture in the bell, the aperture is a through hole that extends between the first side and the second side, the aperture is aligned perpendicular to the disc shape of the bell, the inner rim defines a center of the aperture, the length of the inner rim is greater in than the length of the circumference of the rod, the bell and rod are connected, the connection of the bell and rod includes the interfacing of the inner rim of the bell and outer surface of the rod, the inner rim of the bell having a close-fitting relationship with the outer surface of the rod, the connected bell and rod includes the bell being movable along the length of the rod and relative to the rod, the bell is positioned at a location on the outer the outer surface of the rod, the connected bell and rod includes the bell having rotational movement about the centerline of the rod and relative to the rod; and a pair of stops, each stop of the pair of stops or each stop connects to the rod, each stop interfaces with and is located on the outer surface of the rod, each stop has translational movement along the length of the rod and relative to the rod, each stop is rotatable about the centerline of the rod and relative to the rod, the pair of stops includes a first stop and a second stop, the first stop is located on and fixed at a location on the outer surface of the rod in proximity to the first side of the bell, the second stop is located on and fixed at a location on the outer surface of the rod in proximity to the second side of the bell, the first stop and the second stop retain the bell at the location on the outer surface of the rod between the first stop and the second stop, the first stop and second stop accommodate the rotational movement of the bell about the centerline of the rod and relative to the rod, the first stop in fixed spaced separation on the rod relative to the second stop; and moving the bell music instrument in space while the bell is ringing, the bell music instrument is structured to create a whirl sound effect by the relative motion between a pitch of the ringing bell of the bell music instrument and a static audience.

* * * * *